US009669280B2

(12) United States Patent
Hua

(10) Patent No.: US 9,669,280 B2
(45) Date of Patent: Jun. 6, 2017

(54) FENCING MASK

(71) Applicant: Cheyenne Hua, Bayside, NY (US)

(72) Inventor: Cheyenne Hua, Bayside, NY (US)

( * ) Notice: Subject to any disclaimer, the term of this patent is extended or adjusted under 35 U.S.C. 154(b) by 256 days.

(21) Appl. No.: 14/190,489

(22) Filed: Feb. 26, 2014

(65) Prior Publication Data

US 2015/0238842 A1 Aug. 27, 2015

(51) Int. Cl.
*A63B 71/10* (2006.01)

(52) U.S. Cl.
CPC ..... *A63B 71/10* (2013.01); *A63B 2071/105* (2013.01)

(58) Field of Classification Search
CPC ... A63B 2071/105; A63B 69/02; A63B 71/10; A42B 1/225
See application file for complete search history.

(56) References Cited

U.S. PATENT DOCUMENTS 1,395,761 A * 11/1921 Monro ..... A62B 18/084 128/207.11
1,899,428 A * 2/1933 Solomon ..... A45D 8/14 132/284
2,362,597 A * 11/1944 Vince ..... A63B 71/10 2/173
2,614,570 A * 10/1952 Hall ..... A45D 8/14 132/284
2,924,227 A * 2/1960 Madore ..... A45D 2/122 132/251
3,030,969 A * 4/1962 Epstein ..... A45D 2/122 132/251
4,058,854 A * 11/1977 Rhee ..... A63B 71/10 2/412
4,254,785 A * 3/1981 Cochran ..... A45D 2/122 132/251
4,998,544 A 3/1991 Obergfell
5,535,454 A * 7/1996 Ryan ..... A42B 3/0406 2/209.7
5,615,414 A * 4/1997 Landis ..... A42B 1/22 2/12
5,644,799 A 7/1997 Armenta
5,774,901 A * 7/1998 Minami ..... A42B 3/147 2/421
5,898,950 A * 5/1999 Spyrou ..... A42B 3/085 2/417
5,930,841 A * 8/1999 Lampe ..... A42B 3/00 2/411
6,065,159 A * 5/2000 Hirsh ..... A42B 1/08 2/413

(Continued)

OTHER PUBLICATIONS http://www.blue-gauntlet.com/BG-Olympic-fencing-MASK-universal-1000-NW_p_3654.html, Blue Gauntlet BG "Olympic" Fencing Mask, Item Id: M003.

*Primary Examiner* — Clinton T Ostrup
*Assistant Examiner* — Anne Kozak
(74) *Attorney, Agent, or Firm* — Miskin & Tsui-Yip LLP; Gloria Tsui-Yip, Esq.

(57) ABSTRACT

A fencing mask having a front metal mesh portion, a bib portion extending from a lower portion of the front metal mesh portion, and a securing portion extending from the front metal mesh portion for securing the mask on a user. The securing portion is made up of at least two spaced apart elements that define a gap therebetween for accommodating a user's ponytail.

5 Claims, 6 Drawing Sheets

(56) References Cited

U.S. PATENT DOCUMENTS 6,349,416 B1 * 2/2002 Lampe ..... A42B 3/00 2/411
6,401,255 B1 * 6/2002 Douglas ..... A42B 1/225 2/207
6,401,261 B1 * 6/2002 Arney ..... A42B 3/145 2/421
6,428,167 B1 * 8/2002 Leonardi ..... A61F 9/027 132/273
6,449,777 B1 * 9/2002 Montague ..... A61F 9/025 2/452
6,675,395 B1 * 1/2004 Abraham ..... A42B 3/10 2/181
6,820,286 B2 11/2004 Paul
6,983,488 B2 * 1/2006 Foote ..... A42B 3/003 2/10
7,805,776 B2 * 10/2010 Crossman ..... A42B 3/044 2/410
7,992,228 B2 8/2011 Milea
8,042,198 B1 * 10/2011 Cleveland ..... A42B 3/00 2/171
8,214,928 B1 * 7/2012 Cleveland ..... A42B 1/22 2/410
D680,275 S * 4/2013 Janetos ..... D29/106
8,613,114 B1 * 12/2013 Olivares Velasco ... A42B 3/125 2/171
2002/0157167 A1 * 10/2002 Paul ..... A63B 71/10 2/173
2003/0070202 A1 * 4/2003 Paul ..... A63B 71/10 2/9
2004/0250341 A1 * 12/2004 Lambert ..... A42B 1/08 2/425
2009/0151056 A1 * 6/2009 Desjardins ..... A42B 3/122 2/413
2010/0050324 A1 * 3/2010 Musal ..... A42B 3/145 2/417
2010/0101006 A1 * 4/2010 Cleveland ..... A63B 71/10 2/414
2010/0251465 A1 * 10/2010 Milea ..... A61F 9/027 2/452
2012/0047636 A1 3/2012 Fehmel
2012/0159696 A1 * 6/2012 Polstein ..... A63B 71/10 2/417
2012/0204328 A1 8/2012 Emrich
2012/0210482 A1 * 8/2012 Polstein ..... A42B 3/20 2/9
2013/0212784 A1 * 8/2013 Cleva ..... A42B 3/04 2/413
2013/0232670 A1 * 9/2013 Janetos ..... A42B 3/00 2/414
2013/0239303 A1 * 9/2013 Cotterman ..... A42B 3/08 2/417
2015/0059068 A1 * 3/2015 Tunstill ..... A42B 3/306 2/423
2015/0089723 A1 * 4/2015 Jean ..... A63B 71/10 2/414
2015/0119207 A1 * 4/2015 Yi ..... A63B 69/32 482/84
2015/0135392 A1 * 5/2015 Bono ..... A42B 1/12 2/68
2015/0150330 A1 * 6/2015 Andrews ..... A42B 3/00 2/414
2015/0237944 A1 * 8/2015 Floyd, Jr. ..... A42B 1/08 2/414
2015/0320134 A1 * 11/2015 Stolker ..... A42B 3/069 2/411

* cited by examiner

FENCING MASK

FIELD OF THE INVENTION

The present invention relates to an improved protective head gear for use in the sport of fencing. In particular, the present invention is a fencing mask that can accommodate a user's ponytail.

BACKGROUND OF THE INVENTION

Fencing is a popular sport throughout the world. A fencer wears a set of protective gear to protect him/herself from the weapon, i.e. the sword. As part of the protective gear is a fencing mask that protects the user's head and neck. Prior art fencing mask typically includes a front metal mesh portion that protects the user's head, a bib portion that extends from the lower portion of the front metal mesh portion that protects the user's neck, and a flap portion that extends from the top portion of the front metal mesh portion towards the rear for securing the fencing mask to the user's head. See, for example, U.S. Pat. No. 2,362,597. In order to secure the fencing mask to the user's head, the flap portion is bent at a downward angle to abut the back of the user's head.

Another type of prior art fencing mask uses a disk shape member held by a plurality of elastic straps instead of a flap portion to hold the fencing mask to the user's head. See, for example, U.S. Pat. No. 6,820,286. The disk shape member abuts the back of the user's head.

Prior art fencing mask is unable to conveniently accommodate a user who styles his/her hair in a ponytail at the back of the user's head because the single large flap portion or the disk shape member abuts the back of the user's head where a ponytail is typically positioned. In order to use the prior art fencing masks, a user would have to forego styling his/her hair in a ponytail.

Therefore, there is a need for fencing mask that can accommodate a user's ponytail at the back of his/her head.

SUMMARY OF THE INVENTION

The present invention provides a fencing mask that can accommodate a user's ponytail at the back of the user's head.

The fencing mask of the present invention includes a front metal mesh portion, a bib portion extending from a lower portion of the front metal mesh portion, and a securing portion extending from the front metal mesh portion for securing the mask on a user. The securing portion is formed from at least two spaced apart extension elements that define a gap therebetween for accommodating a user's ponytail.

BRIEF DESCRIPTION OF THE DRAWINGS

Preferred embodiments of the present invention have been chosen for purposes of illustration and description and are shown in the accompanying drawings forming a part of the specification wherein.

DETAILED DESCRIPTION OF THE PREFERRED EMBODIMENTS

Figure 1:
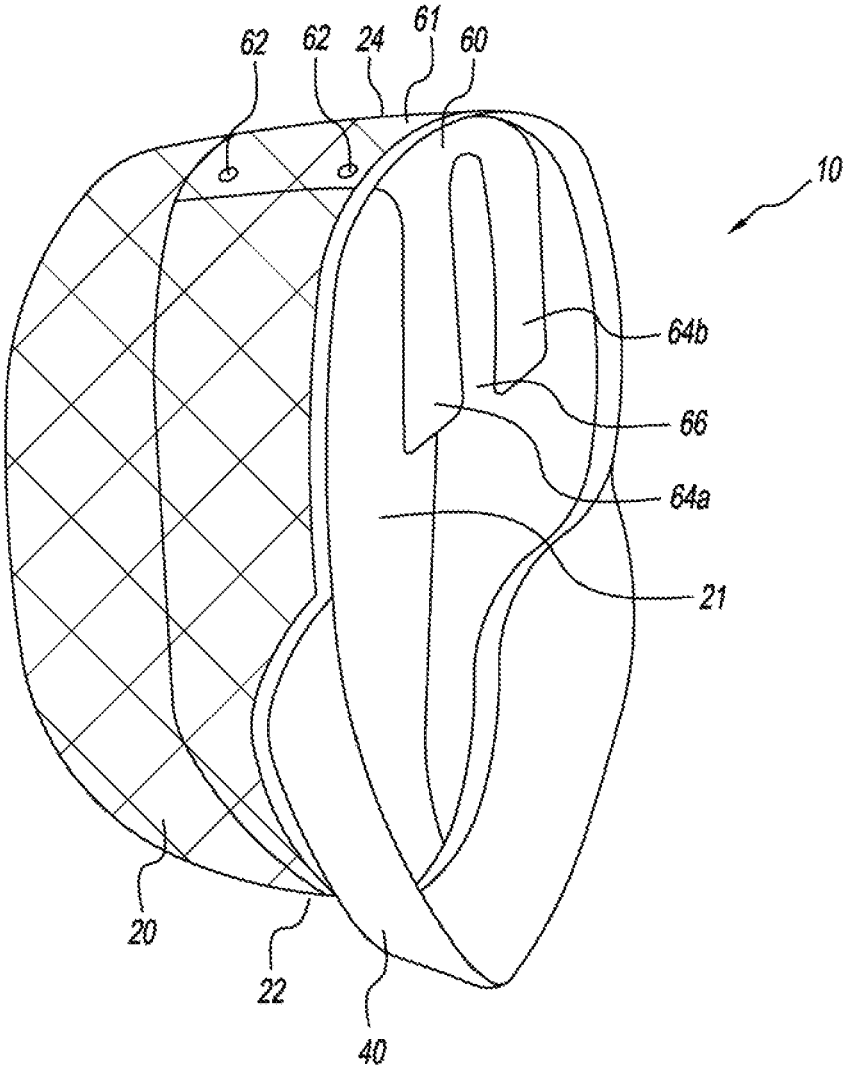
FIG. 1 is a perspective view of the fencing mask of the present invention.

With reference to the drawings, wherein the same reference number indicates the same element throughout, there is shown in FIG. 1 a fencing mask 10 of the present invention comprises a front metal mesh portion 20, a bib portion 40, and a securing portion 60.

The front metal mesh portion 20 forms a generally dome shape, stiff, cavity 21 for enclosing a user's face and sides of the head. The front metal mesh portion 20 may have various shapes and sizes to accommodate different users' heads. The material used for the front metal mesh portion 20 may be steel or other materials known to one skilled in the art.

The bib portion 40 extends from a lower portion 22 of the front metal mesh portion 20 for covering a user's neck. The bib portion 40 may have various shapes and length to accommodate different users. The material used for the bib portion 40 may be reinforced fabric, a metallic fabric or other materials known to one skilled in the art.

The securing portion 60 extends from a top portion 24 of the front metal mesh portion 20 for securing the fencing mask 10 to the user's head. The securing portion 60 includes a main portion 61 and a pair of extension elements 64*a* and 64*b* extending from the main portion 61.

The main portion 61 is mounted to the top portion 24 of the front metal mesh portion 20 by rivets 62 or other secured fastening means known to one skilled in the art. The extension elements 64*a* and 64*b* extend away from the front metal mesh portion 20 and when in use, are bent at a downward angle as shown. The extension elements 64*a* and 64*b* define an elongated gap 66 therebetween to accommodate a user's ponytail.

Figure 2:
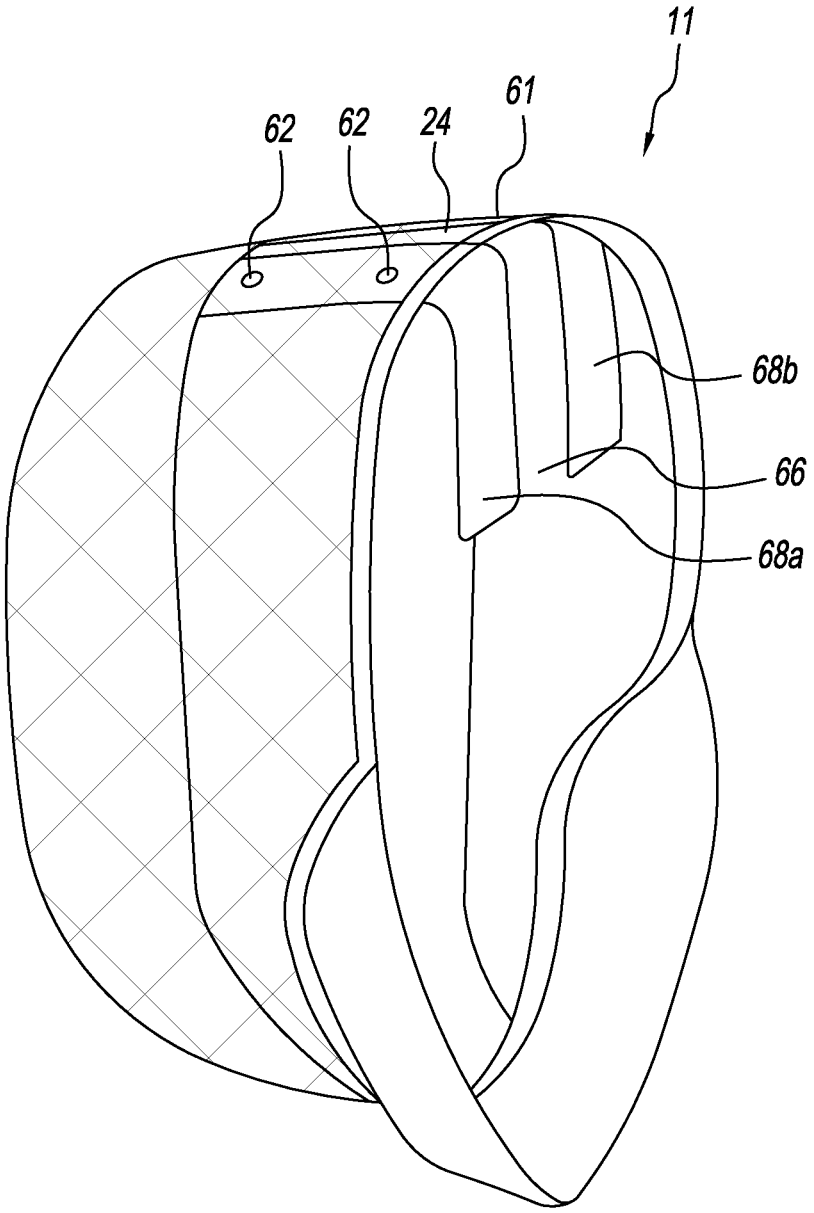
FIG. 2 is a perspective view of another embodiment of the fencing mask of the present invention.

As shown in FIG. 2, the fencing mask 11 of the present invention has a securing portion 61 that includes two distinct flap elements 68*a* and 68*b*. One end of each flap elements 68*a* and 68*b* is mounted to the top portion 24 of the front metal mesh portion 20 by rivets 62 or other secured fastening means known to one skilled in the art. The other end of the flap elements 68*a* and 68*b* extend away from the front metal mesh portion 20 and when in use, are bent at a downward angle as shown. The flap elements 68*a* and 68*b* define an elongated gap 66 therebetween to accommodate a user's ponytail.

Figure 3:
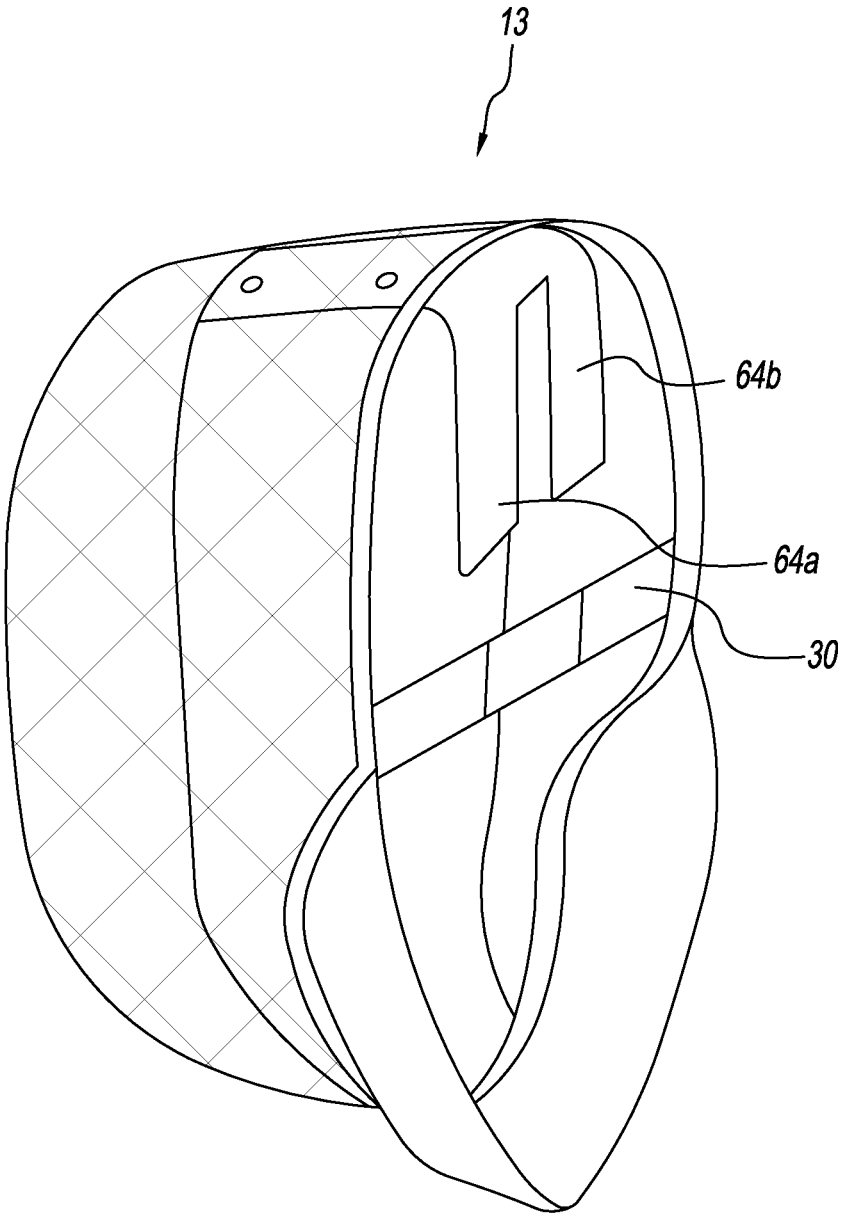
FIG. 3 is a perspective view of the fencing mask of FIG. 1 with an elastic strap.

FIG. 3 shows a fencing mask 13 that is identical to fencing mask 10 as shown in FIG. 1 except that it further includes an elastic strap 30. The elastic strap 30 extends horizontally across the cavity 21 from the left side to the right side of the front metal mesh portion 20 to aid in securing the fencing mask 13 to a user's head. A user's ponytail may be accommodated above the strap 30 and between the extension elements 64*a* and 64*b*. While only one strap 30 is shown in FIG. 3, more straps can be used to further aid in securing the fencing mask 13 to the user. Further, while the strap 30 is shown to be positioned horizontally, the strap 30 may also be positioned diagonally at any angle.

Figure 4:
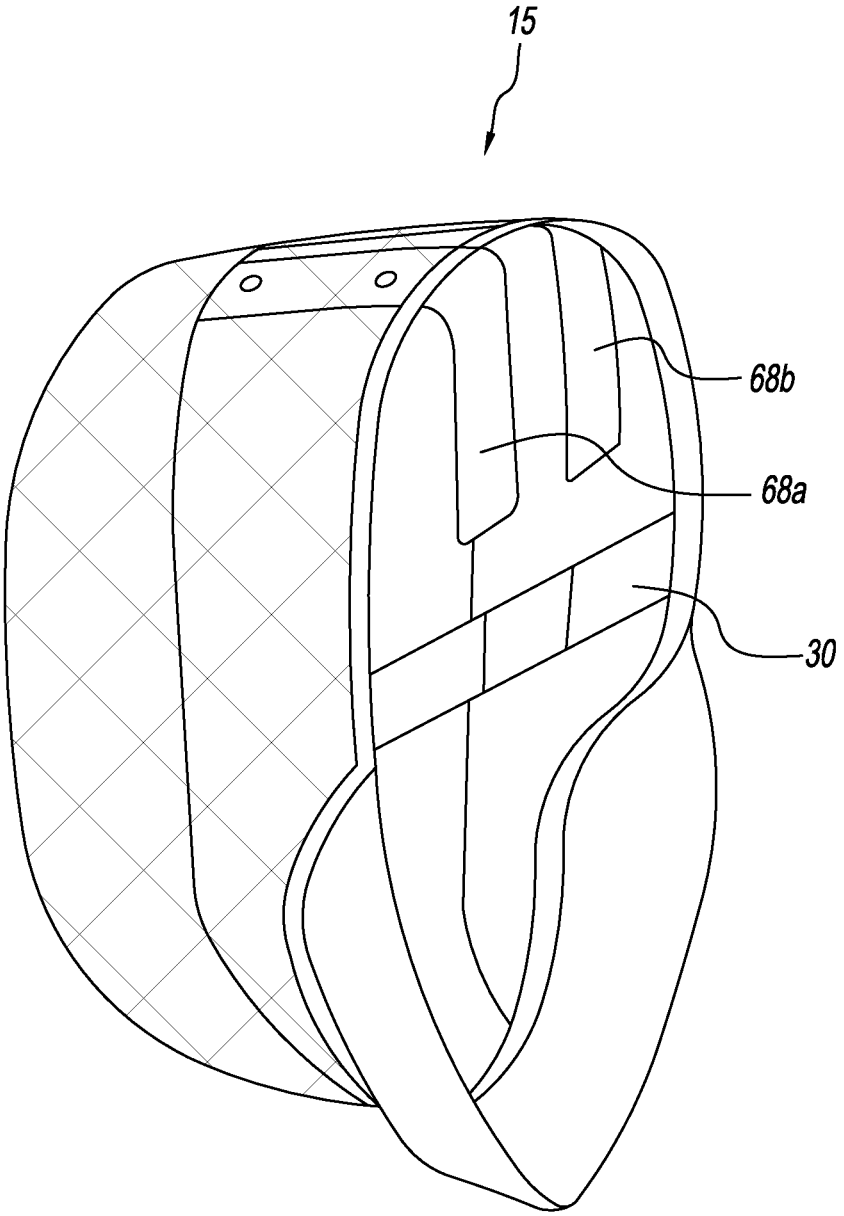
FIG. 4 is a perspective view of the fencing mask of FIG. 2 with an elastic strap.

FIG. 4 shows a fencing mask 15 that is identical to fencing mask 11 as shown in FIG. 2 except that it further includes an elastic strap 30, similar to that of FIG. 3 and as described in connection with FIG. 3.

Figure 5A:
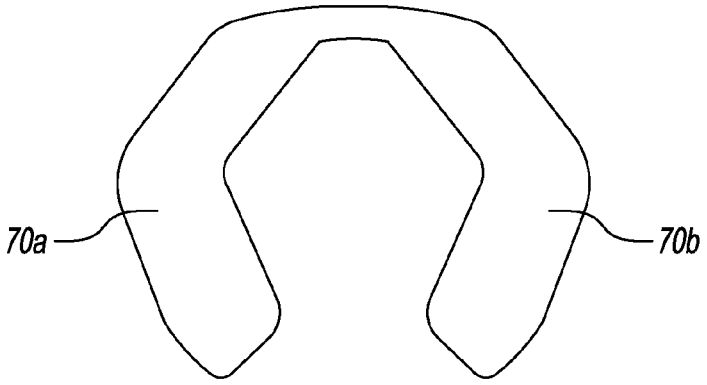
FIGS. 5A to 5C are rear views of various embodiments of the extension elements of the present invention.
Figure 5B:
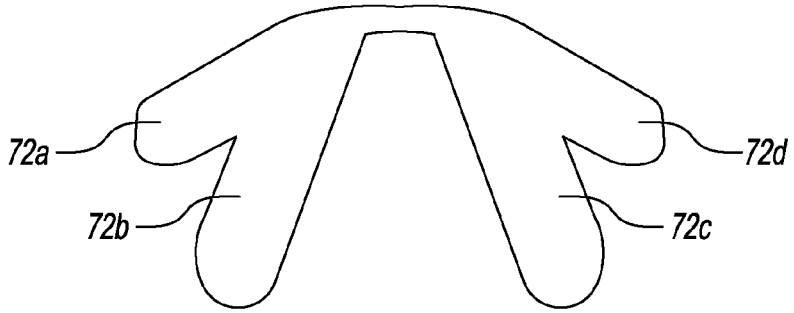
Figure 5C:
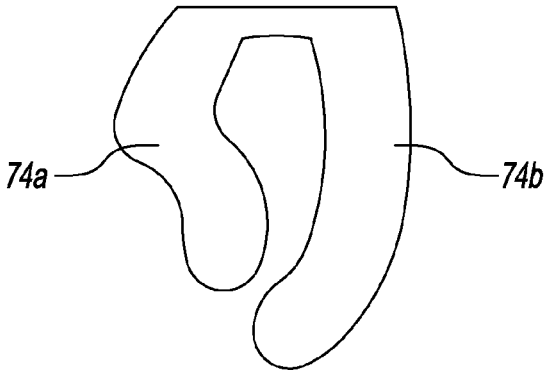

While the extension elements 64*a* and 64*b* and flap elements 68*a* and 68*b* in FIGS. 1 to 4 are shown to be generally rectangular in shape, other shapes and sizes that can hold the fencing masks 10, 11, 13 or 15 in position can be used. Further, while the extension elements 64*a* and 64*b* and flap elements 68*a* and 68*b* are shown in pairs and to be generally parallel and symmetric to a vertical axis, it is not necessarily so. FIGS. 5A to 5C illustrate variations of the extension elements 70*a* and 70*b*, 72*a* to 72*d*, and 74*a* and 74*b*, having different numbers, shapes and configurations. The numbers, shapes and configurations of the extension elements shown in FIGS. 5A and 5C can similarly be that of the flap elements.

Figure 6:
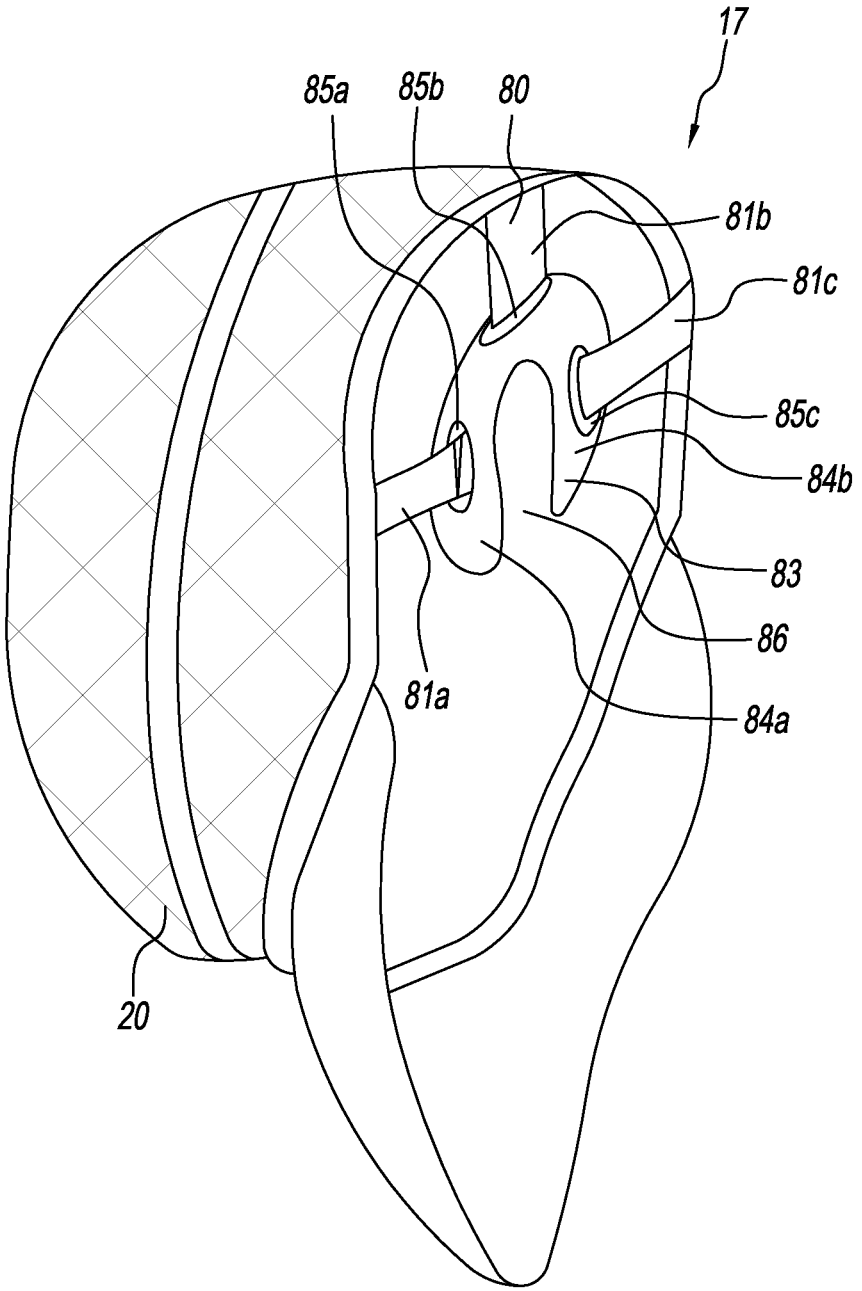
FIG. 6 is a perspective view of another embodiment of the fencing mask of the present invention with the extension element mounted on elastic straps.

FIG. 6 shows another embodiment of the fencing mask 17 having a securing portion 80 that includes a plurality of elastic straps 81*a*, 81*b*, 81*c* and a holding element 83. The holding element 83 has a substantially upside down U-shape configuration with two integral arms 84*a*, 84*b* defining a gap 86 therebetween to accommodate a user's ponytail. The holding element 83 has a plurality of slots 85*a*, 85*b*, 85*c* to receive and secure the plurality of elastic straps 81*a*, 81*b* and 81 c thereon by means known to one skilled in the art. The holding element 83 is secured to the front metal mesh portion 20 at the top portion 24, at the left side and at the right side with straps 81*b*, 81a and 81*c*, respectively, by means known to one skilled in the art.

The features of the invention illustrated and described herein are the preferred embodiments. Therefore, it is understood that the specification is intended to cover unforeseeable embodiments with insubstantial differences that are within the spirit of the specification.

What I claim is:

1. A fencing mask for accommodating a user's ponytail comprising:

a front metal mesh portion having a top portion and a lower portion and a vertical axis of symmetry;

a bib portion extending from the lower portion of said front metal mesh portion; and a bendable securing portion including a main portion and at least two extension elements extending from a main portion, wherein the main portion is mounted to the top portion of the front metal mesh portion by a plurality of rivets, and extending downward from said upper top portion of said front metal mesh portion for securing the mask on a user;

wherein at least two extension elements bend to any downward position to abut and secure the mask to the back of the user's head, each element having a proximate end adjacent said top portion and a distal, free, end furthest from said top portion, said at least two extension elements defining an unobstructed gap at said vertical axis that extends from said proximate ends metal mesh portion through said distal, free, ends, and said distal, free ends of said at least two extension elements defining an opening for access to said gap, wherein said opening is adapted to receive the user's ponytail through said opening to access said gap and said gap is adapted to accommodate the user's ponytail at said gap from said proximate ends to said opening.

2. The fencing mask of claim 1 wherein said front metal mesh portion further having a left side and a right side, said securing portion further comprises:

at least one elastic strap extending across said left and right sides spaced apart from said distal, free, ends of said at least two extension elements of said securing portion.

3. The fencing mask of claim 1 wherein one of said at least two extension elements has a generally rectangular shape having an elongated part with some portion resembling rectangle.

4. The fencing mask of claim 1 wherein said at least two extension elements are symmetrically shaped and positioned with respect to the vertical axis of symmetry.

5. The fencing mask of claim 1 wherein said at least two extension elements are not symmetrically shaped nor positioned with respect to said vertical axis.

* * * * *